US009355609B2

(12) United States Patent
Son et al.

(10) Patent No.: US 9,355,609 B2
(45) Date of Patent: May 31, 2016

(54) MALFUNCTION PREVENTION CIRCUIT FOR COG-FORM SOURCE DRIVER INTEGRATED CIRCUIT AND FLAT PANEL DISPLAY CONTROLLER EMPLOYING THE SAME

(71) Applicant: SILICON WORKS CO., LTD., Daejeon-si (KR)

(72) Inventors: Yeong Joon Son, Daejeon-si (KR); Myung Yu Kim, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 122 days.

(21) Appl. No.: 13/891,081

(22) Filed: May 9, 2013

(65) Prior Publication Data

US 2013/0300726 A1 Nov. 14, 2013

(30) Foreign Application Priority Data

May 10, 2012 (KR) ..... 10-2012-0049931

(51) Int. Cl.
*G09G 5/00* (2006.01)
*G09G 3/36* (2006.01)

(52) U.S. Cl.
CPC ..... *G09G 5/00* (2013.01); *G09G 3/3674* (2013.01); *G09G 2310/0289* (2013.01); *G09G 2330/02* (2013.01); *G09G 2330/04* (2013.01)

(58) Field of Classification Search
None
See application file for complete search history.

(56) References Cited

U.S. PATENT DOCUMENTS

| | | | | |
|---|---|---|---|---|
| 7,675,343 | B2 * | 3/2010 | Kwon | 327/333 |
| 2007/0030221 | A1 * | 2/2007 | Pak | G02F 1/13338 345/87 |
| 2007/0114984 | A1 * | 5/2007 | Li et al. | 323/283 |
| 2010/0006783 | A1 * | 1/2010 | Kwon et al. | 250/551 |
| 2010/0141627 | A1 * | 6/2010 | Yamashita | G09G 3/3233 345/211 |

FOREIGN PATENT DOCUMENTS

| | | |
|---|---|---|
| KR | 10-2004-0002296 | 1/2004 |
| KR | 10-0483534 | 9/2005 |
| KR | 10-2008-0103472 | 11/2008 |

* cited by examiner

*Primary Examiner* — Adam R Giesy
*Assistant Examiner* — Henok Heyi
(74) *Attorney, Agent, or Firm* — Kile Park Reed & Houtteman PLLC

(57) ABSTRACT

Provided is a malfunction prevention circuit for a COG-form source driver integrated circuit with a power sequence in which a low voltage is applied after a high voltage is applied. The malfunction prevention circuit includes: a level shifter configured to process an input signal using the low voltage and output a control signal using the high voltage; and an initialization circuit configured to initialize the control signal to a constant voltage while an initialization signal is enabled. The initialization signal is enabled during a predetermined time from the time at which the low voltage starts to be applied at the initial stage of the power sequence.

19 Claims, 5 Drawing Sheets

MALFUNCTION PREVENTION CIRCUIT FOR COG-FORM SOURCE DRIVER INTEGRATED CIRCUIT AND FLAT PANEL DISPLAY CONTROLLER EMPLOYING THE SAME

BACKGROUND OF THE INVENTION

1. Field of the Invention

The present invention relates to a flat panel display controller, and more particularly, to a malfunction prevention technology for a source driver integrated circuit, which is capable of improving a malfunction occurring during the initial interval of a power sequence in a source driver integrated circuit mounted in a chip-on-glass (COG) form on a flat panel display.

2. Description of the Related Art

A flat panel displays receives data from a source device and displays the received data. The flat panel displays is used for various fields such as television and smart phone.

The flat panel displays include a liquid crystal display (LCD), an organic light emitting diodes (OLED) and so on. For example, the LCD generates an internal voltage required for operation and uses the generated voltage to drive a digital logic circuit or analog circuit.

The operation stability of internal circuits of the LCD may be guaranteed through a stable power sequence environment. For the operation stability, a variety of techniques have been adopted.

Korean Patent No. 10-0483534 may be taken as an example of a technique for seeking the stability of a power sequence environment of an LCD.

Korean Patent No. 10-0483534 has disclosed a technique for solving a problem which occurs when a low voltage used as digital power is applied after a high voltage used as analog power is applied to a source driver integrated circuit. According to this technique, when power is applied to a source driver integrated circuit of an LCD, a low voltage is first applied and a high voltage is then applied, in order to secure the reliability and stability of circuit elements.

As disclosed in Korean Patent No. 10-0483534, a general LCD employs the power sequence in which a low voltage is applied after a high voltage is applied.

In the flat panel displays such as the LCD, the source driver integrated circuit is mounted in a COG form in many cases. As such, the source driver integrated circuit mounted on glass is defined as a COG-form source driver integrated circuit. The COG-form source driver integrated circuit sequentially receives a high voltage and a low voltage from a printed circuit board (PCB) according to the power sequence.

When the COG-form source driver integrated circuit is mounted in the flat panel displays, the COG-form source driver integrated circuit may malfunction due to the power sequence of internal voltages provided from the PCB.

In general, the COG-form source driver integrated circuit includes buffers configured to output an even signal and an odd signal which have opposite polarities and a multiplexer configured to select one of the signals outputted from the buffers and output the selected signal. The multiplexer includes a plurality of transmission gates which are switched according to a control signal outputted from a level shifter. The multiplexer includes a transmission gate configured to isolate or equalize a line for outputting an even signal and a line for outputting an odd signal.

The level shifter includes a low-voltage logic and a high-voltage logic. The low-voltage logic is driven by a low voltage so as to process an input signal, and the high-voltage logic is driven by a high voltage so as to process an output signal.

In general, according to the power sequence, a low voltage is applied to the level shifter in a predetermined time after a high voltage is applied. Thus, the level shifter recognizes an input signal as a low level during an interval from the time at which the high voltage is applied to the time at which the low voltage is applied, and outputs a control signal as an output signal in a random state.

When the control signal outputted from the level shifter is maintained in a random state, all of the transmission gates of the multiplexer switched by the control signal of the level shifter may be turned on. As a result, the lines for outputting an odd signal and the lines for outputting an even signal in the buffers may be shorted by the turned-on transmission gates.

The high voltage and the low voltage which are provided to the COG-form source driver integrated circuit from the PCB include a driving voltage and a ground voltage, respectively. When the lines for outputting an odd signal and the lines for outputting an even signal in the buffers are shorted as described above, a terminal to provide a high-voltage driving voltage and a terminal to provide a high-voltage ground voltage in the PCB may be electrically connected to each other through the shorted path of the COG-form source driver integrated circuit.

Therefore, an over-current flow may occur through the shorted path of the COG-form source driver integrated circuit. The over current flows through the high-voltage driving voltage terminal, the shorted path of the COG-form source driver integrated circuit, and the high-voltage ground voltage terminal. At this time, a low-voltage driving voltage terminal and a low-voltage ground voltage terminal are isolated from the terminals for high voltages, and are not influenced by an over-current caused by the shorted path.

The COG-form source driver integrated circuit has a resistance component existing at a power source due to the characteristic of the COG form. Thus, in the COG-form source driver integrated circuit, the level of the high-voltage ground voltage rises due to an over-current caused by the shorted path within the multiplexer.

Although the input of the level shifter is normalized after a low voltage is applied according to the power sequence, a transistor included in the high voltage logic of the level shifter abnormally operates due to the rising level of the ground voltage. More specifically, a voltage difference between the gate and source of the transistor included in the high voltage logic does not exceed a threshold voltage due to the rising level of the ground voltage.

Therefore, the COG-form source driver integrated circuit of the flat panel display may malfunction due to the malfunction of the level shifter which is caused by the shorted path at the initial stage of the power sequence.

Furthermore, in the COG-form source driver integrated circuit of the flat panel displays, an over-current caused by the above-described shorted path may be continuously maintained. As a result, internal parts of the COG-form source driver integrated circuit may be damaged by the over-current.

SUMMARY OF THE INVENTION

Accordingly, the present invention has been made in an effort to solve the problems occurring in the related art, and an object of the present invention is to prevent malfunctioning of a source driver integrated circuit mounted in a COG form due to an unstable output of a level shifter at the initial stage of a power sequence.

Another object of the present invention is to prevent a malfunction of a source driver integrated circuit mounted in a COG form on a flat panel display such as an LCD by preventing an unstable output of a level shifter at the initial stage of a power sequence.

Another object of the present invention is to protect parts of a source driver integrated circuit from being damaged by an over-current caused by a shorted path occurring at the initial stage of a power sequence when a source driver integrated circuit is mounted in a COG form on a flat panel display.

In order to achieve the above object, according to one aspect of the present invention, there is provided a malfunction prevention circuit for a COG-form source driver integrated circuit with a power sequence in which a low voltage is applied after a high voltage is applied. The malfunction prevention circuit includes: a level shifter configured to process an input signal using the low voltage and output a control signal using the high voltage; and an initialization circuit configured to initialize the control signal to a constant voltage while an initialization signal is enabled. The initialization signal is enabled during a predetermined time from the time at which the low voltage starts to be applied at the initial stage of the power sequence.

According to another aspect of the present invention, there is provided a malfunction prevention circuit of a COG-form source driver integrated circuit with a power sequence in which a low voltage is applied after a high voltage is applied. The malfunction prevention circuit includes: a plurality of level shifters each configured to provide an input signal using the low voltage and output a control signal using the high voltage; a multiplexer driver configured to transmit the control signals of the plurality of level shifters to corresponding multiplexers; and a plurality of initialization circuits configured to initialize output terminals of the plurality of level shifters to a constant voltage in response to an initialization signal which is enabled during a predetermined time from the time at which the low voltage starts to be applied at the initial stage of the power sequence.

According to another aspect of the present invention, there is provided a flat panel display controller including: a printed circuit board having a power sequence in which a low voltage is applied after a high voltage is applied; and a COG-form source driver integrated circuit configured to receive the high voltage and the low voltage. The COG-form source driver integrated circuit includes: multiplexers configured to select and output one of an even signal and an odd signal; a plurality of level shifters each configured to provide an input signal using the low voltage and output a control signal using the high voltage; a multiplexer driver configured to transmit the control signals of the plurality of level shifters to corresponding multiplexers; and a plurality of initialization circuits configured to initialize output terminals of the plurality of level shifters to a constant voltage in response to an initialization signal which is enabled during a predetermined time from the time at which the low voltage starts to be applied at the initial stage of the power sequence.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
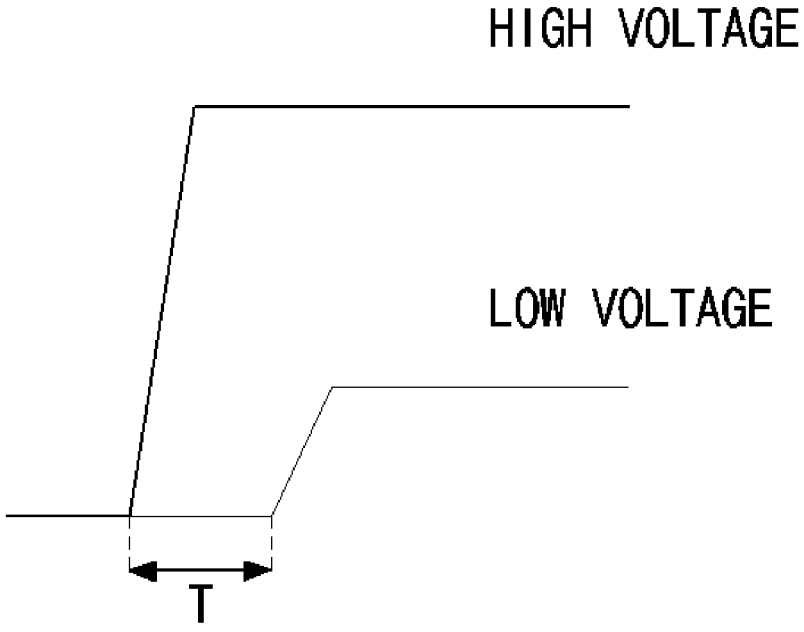
FIG. 1 is a graph illustrating a power sequence of an flat panel displays according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

The embodiments of the present invention provide a configuration for preventing a source driver integrated circuit mounted in the COG form on a flat panel display from malfunctioning due to an unstable output of a level shifter at the initial stage of a power sequence. The flat panel displays include the LCD, the OLED and so on.

The embodiments of the present invention operate according to a power sequence in which a low voltage is applied after a high voltage is applied, as illustrated in FIG. 1. The low voltage may include a high-level driving voltage VCCD (Hereinafter, referred to as a low-voltage driving voltage VCCD) and a low-level ground voltage VSSD (Hereinafter, referred to as a low-voltage ground voltage VSSD), and the high voltage may include a high-level driving voltage VDDH (Hereinafter, referred to as a high-voltage driving voltage VDDH) and a low-level ground voltage VSSH (Hereinafter, referred to as a high-voltage ground voltage).

The power sequence of FIG. 1 is implemented in such a manner that a high voltage and a low voltage are sequentially applied with a predetermined time difference T at the initial stage.

Figure 2:
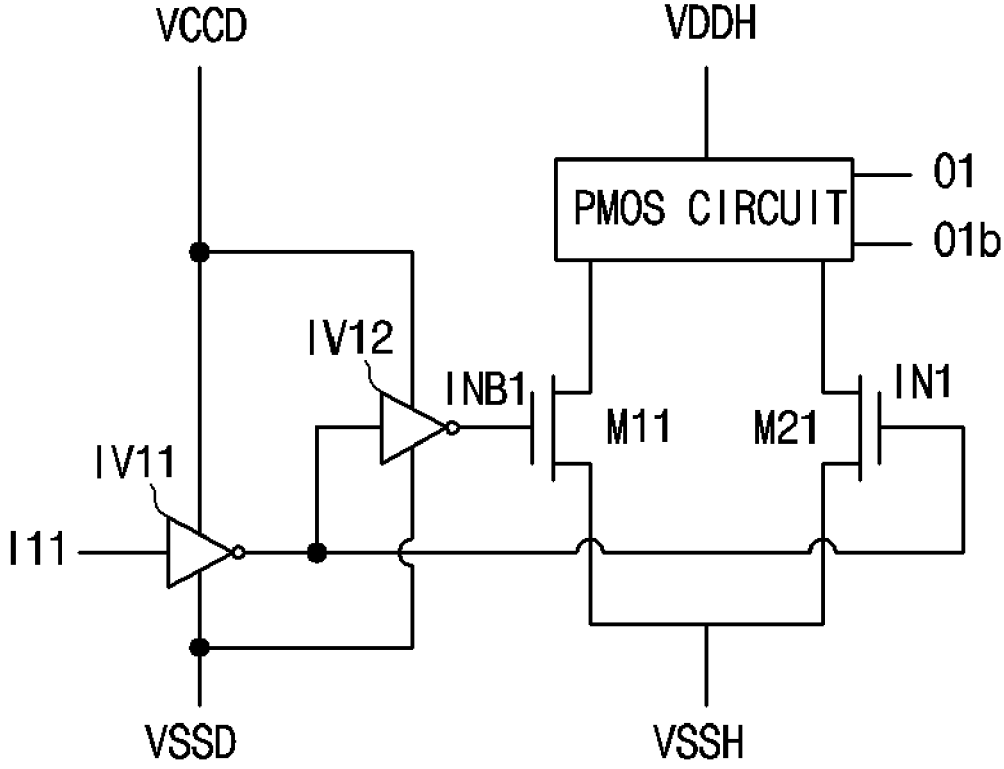
FIGS. 2 and 3 are circuit diagrams illustrating examples of a level shifter mounted on a source driver integrated circuit.
Figure 3:
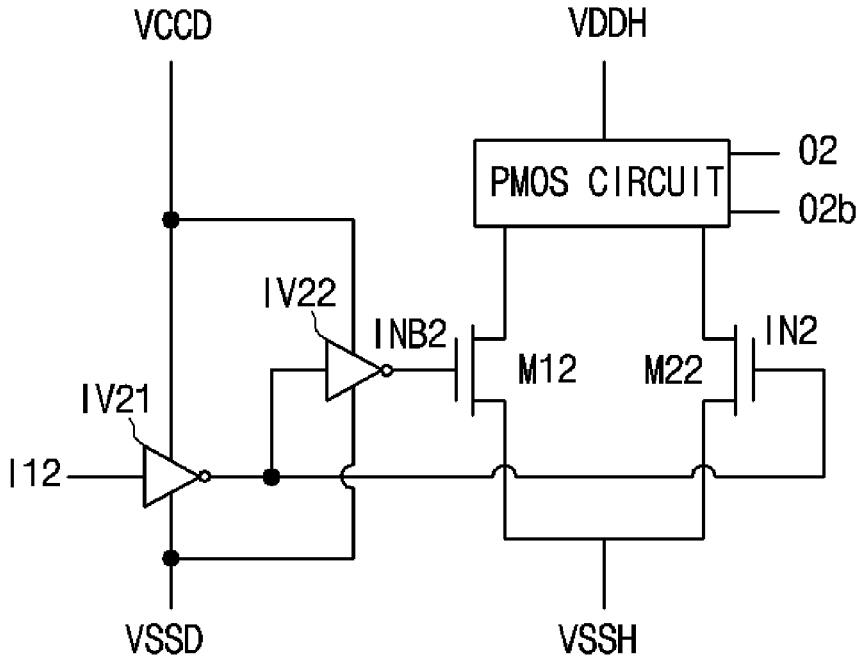
Figure 4:
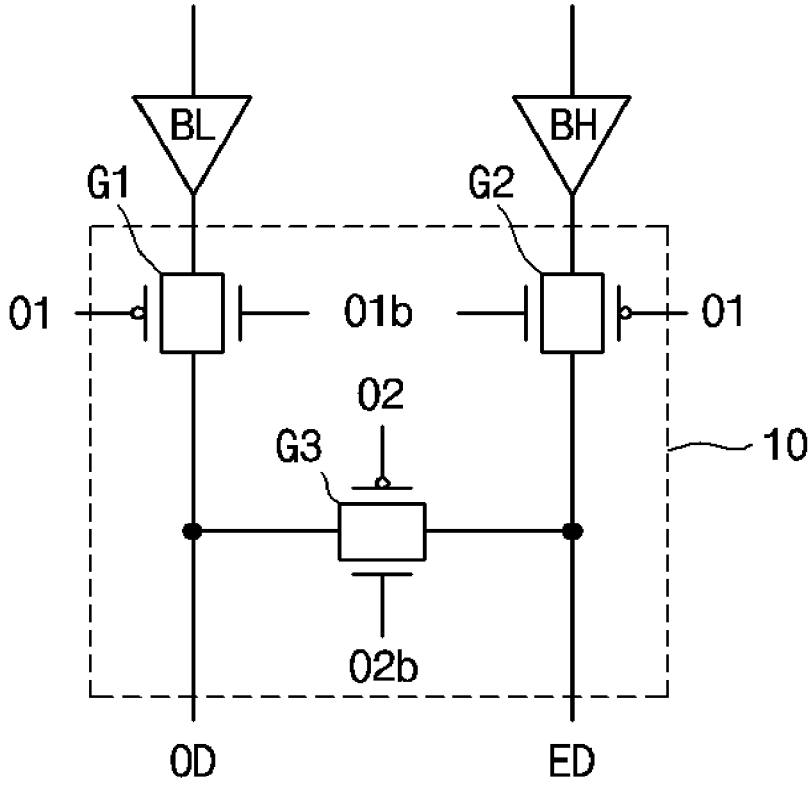
FIG. 4 is a circuit diagram illustrating an example of a multiplexer mounted in a COG-form source driver integrated circuit according to an embodiment of the present invention.

A COG-form source driver integrated circuit includes a level shifter as illustrated in FIGS. 2 and 3 and a multiplexer 10 to switch outputs of buffers BL and BH as illustrated in FIG. 4.

The level shifter of FIG. 2 is configured to provide control signals 01 and 01*b* for complementarily driving a transmission gate G1 of the buffer BL and a transmission gate G2 of the buffer BH, which are included in the multiplexer 10 of FIG. 4. The control signal 01 indicates a non-inverted signal, and the control signal 01*b* indicates an inverted signal.

The level shifter of FIG. 3 is configured to provide control signals 02 and 02*b* for resetting a transmission gate G3 to equalize an odd signal (OD) output line connected to the buffer BL and an even signal (ED) output line connected to the buffer BH in FIG. 4 at the initial stage of the power sequence. The control signal 02 indicates a non-inverted signal, and the control signal 02*b* indicates an inverted signal.

The level shifter of FIG. 2 includes inverters IV11 and IV12, a PMOS circuit, and NMOS transistors M11 and M21. The inverters IV11 and IV12 forming an input circuit are driven by a low-voltage driving voltage VCCD and a low-voltage ground voltage VSSD, and the PMOS circuit and the NMOS transistors M11 and M21 forming an output circuit are driven by a high-voltage driving voltage VDDH and a high voltage ground voltage VSSH.

The level shifter of FIG. 3 also includes inverters IV21 and IV22, a PMOS circuit, and NMOS transistor M12 and M22. The inverters IV21 and IV22 forming an input circuit are driven by a low voltage driving voltage VCCD and a low-voltage ground voltage VSSD, and the PMOS circuit and the NMOS transistors M12 and M22 forming an output circuit are driven by a high-voltage driving voltage VDDH and a high-voltage ground voltage VSSH.

The PMOS circuit of FIGS. 2 and 3 includes a plurality of PMOS transistors (not illustrated) connected in parallel, and is typically configured to output the complementary control signals 01 and 01*b* or 02 and 02*b*. Thus, the detailed descriptions thereof are omitted herein.

FIG. 4 illustrates the multiplexer 10 for switching an odd signal OD outputted from the buffer BL and an even signal ED outputted from the buffer BH.

In the multiplexer 10, the transmission gate G1 is connected at an output terminal of the buffer BL, the transmission gate G2 is connected at an output terminal of the buffer BH, and the transmission gate G3 for equalizing and resetting the odd signal output line and the even signal output line is connected between output terminals of the transmission gates G1 and G2.

Each of the transmission gates G1, G2, and G3 includes an NMOS transistor and a PMOS transistor which are connected in parallel, and is configured to be switched by complementary control signals.

The transmission gate G1 is configured to receive the control signals 01 and 01*b* of the level shifter of FIG. 2 to an inverting gate and a non-inverting gate thereof, respectively. The transmission gate G2 is configured to receive the control signals 01 and 01*b* of the level shifter of FIG. 2 to an inverting gate and a non-inverting gate thereof, respectively. Furthermore, the transmission gate G3 is configured to receive the control signals 02 and 02*b* of the level shifter of FIG. 3 to an inverting gate and a non-inverting gate thereof, respectively.

In the level shifter of FIGS. 2 and 3, the input circuit is configured with low-voltage logic, and the output circuit is configured with high-voltage logic.

The level shifter of FIGS. 2 and 3 sequentially receives a high voltage and a low voltage according to the power sequence of FIG. 1. During an interval having a time difference T between the time at which the high voltage is applied and the time at which the low voltage is applied, the input of the level shifter becomes low and the output of the level shifter becomes random.

When the output of the level shifter is random, all of the transmission gates G1, G2, and G3 of the multiplexer 10 of FIG. 4 may be turned on. That is, the odd signal output line connected to the buffer BL and the even signal output line connected to the buffer BH may be shorted.

In the COG-form source driver integrated circuit, resistance components are applied to terminals to which power is provided, due to the characteristic of the COG form. The resistance components include resistance caused by a flexible substrate for electrically connecting a PCB to glass on which the COG-form driver integrated circuit is mounted and resistance caused by a line for power transmission on glass.

Figure 5:
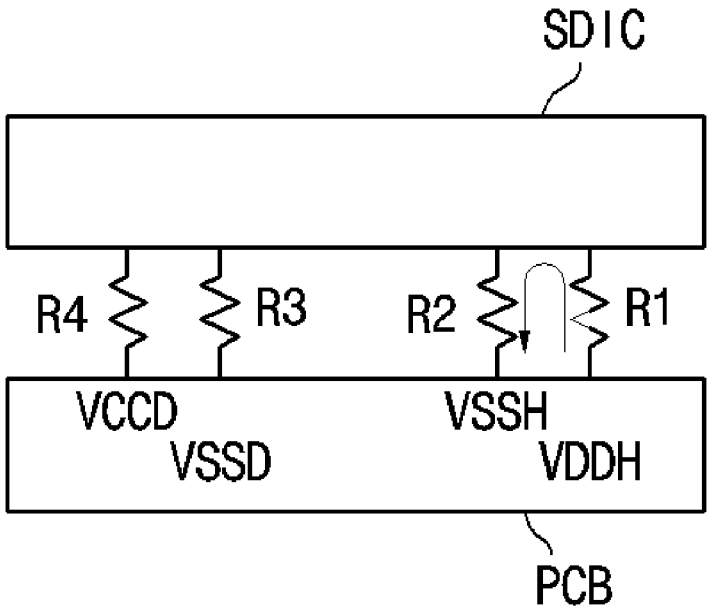
FIG. 5 is schematic view for explaining a path through an over-current caused by a shorted path flows.
Figure 6:
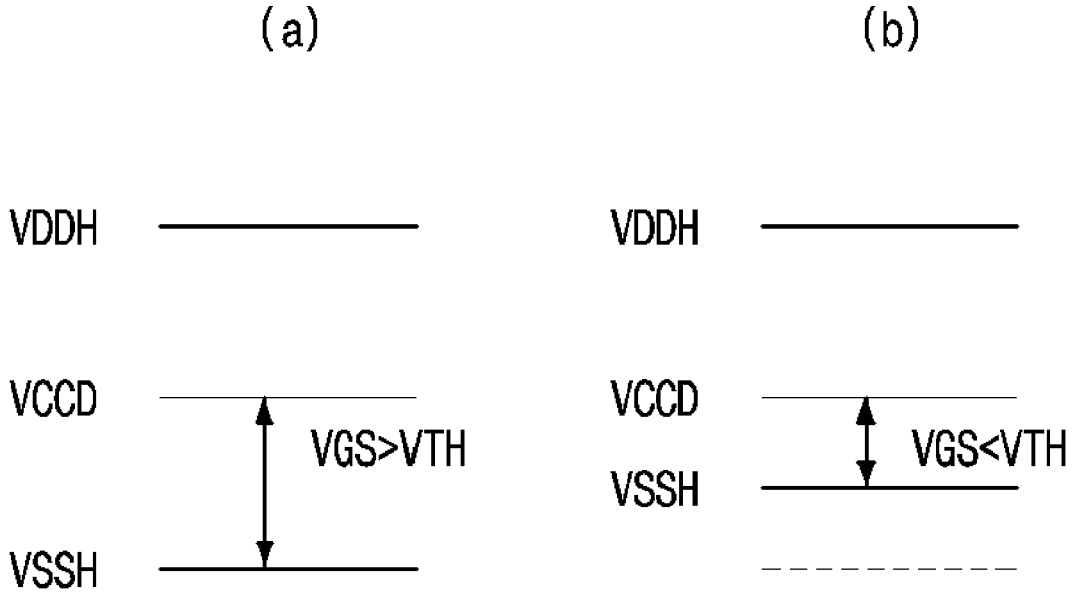
FIG. 6 is a diagram for explaining changes of a high-voltage ground voltage caused by a short circuit.

Thus, when a shorted path is formed within the multiplexer 10 of FIG. 4, an over-current caused by the shorted path may flow through the terminal biased the high-voltage driving voltage VDDH, the resistance component R1, the COG-form source driver integrated circuit SDIC, the resistance component R2, and the terminal biased the high-voltage ground voltage VSSH as illustrated in FIG. 5. As a result, the high voltage ground voltage VSSH may change from a state of FIG. 6 (*a*) to a state of FIG. 6 (*b*) due to the shorted path.

Figure 7:
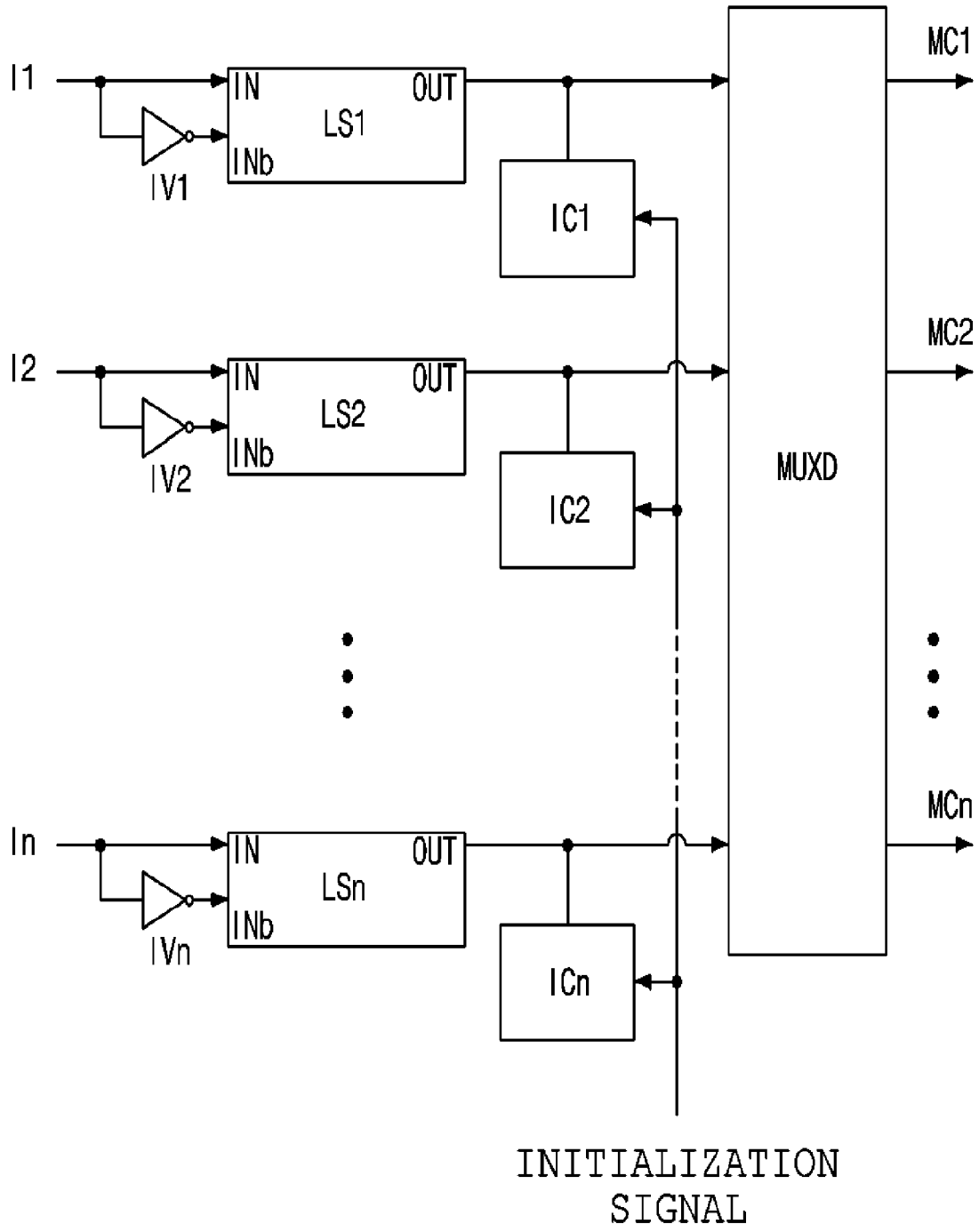
FIG. 7 is a block diagram illustrating a preferred embodiment of the present invention.
Figure 8:
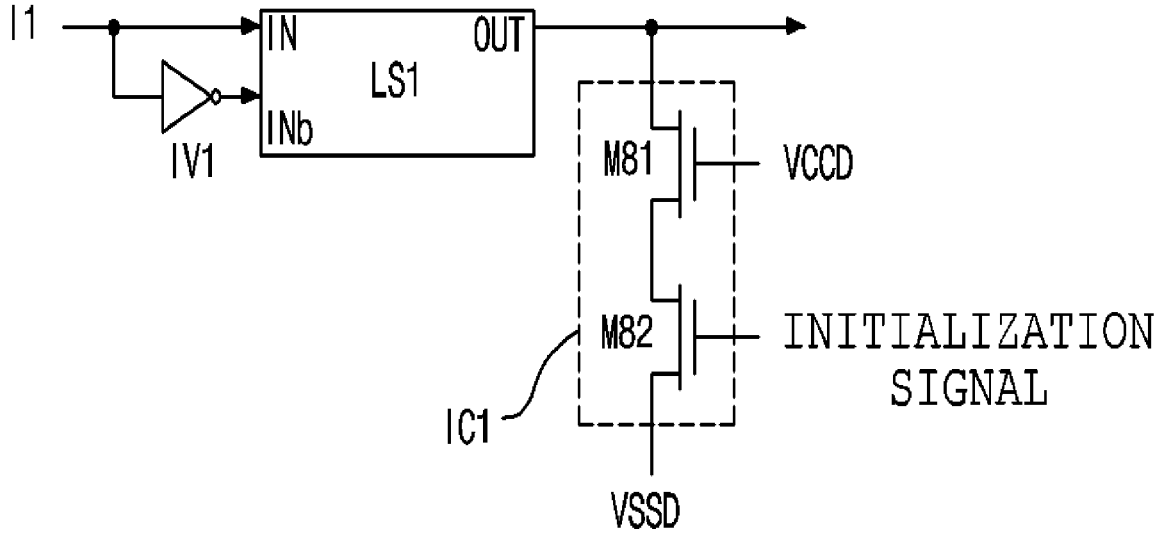
FIG. 8 is a detailed circuit diagram of a level shifter and an initialization circuit of FIG. 7.

The embodiment of the present invention may be configured as illustrated in FIGS. 7 and 8, in order to prevent a malfunction due to the above-described shorted path and over-current flow.

FIG. 7 illustrates a malfunction prevention circuit for the COG-form source driver circuit according to the embodiment of the present invention.

The malfunction prevention circuit of FIG. 7 includes level shifters LS1, LS2, . . . , LSn, initialization circuits IC1, IC2, . . . , ICn, and a multiplexer driver MUXD.

The level shifters LS1, LS2, . . . , LSn are configured to receive inputs I1 to In, respectively. The level shifters LS1, LS2, . . . , LSn receive the inputs I1, I2, . . . , In as non-inverted inputs IN and receive outputs of inverters IV1, IV2, . . . , IVn as inverted inputs INb. The inverters IV1, IV2, . . . , IVn are configured to invert the inputs I1 to In and provide the inverted inputs to the respective level shifters LS1, LS2, . . . , LSn.

Each of the level shifters LS1, LS2, . . . , LSn indicates the level shifter of FIG. 2. The detailed illustration of the level shifter of FIG. 3, required to drive the multiplexer 10 of FIG. 4, is omitted from FIG. 7, in order to clarify the description of the embodiment of the present invention.

The initialization circuits IC1, IC2, . . . , ICn are connected to output terminals OUT of the respective level shifters LS1, LS2, . . . , LSn, and configured to initialize control signals outputted from the respective level shifters LS1, LS2, . . . , LSn to a constant voltage while an initialization signal is enabled. The low-voltage ground voltage VSSD may be used as the constant voltage.

The multiplexer driver MUXD includes a plurality of input terminals and a plurality of output terminals to transmit the control signals outputted from the respective level shifters LS1, LS2, . . . , LSn to the multiplexer 10. The output signals MC1, MC2, . . . , MCn of the multiplexer driver MUXD correspond to the non-inverted signal 01 and the inverted signal 01*b* of FIG. 4.

Each of the initialization circuits IC1, IC2, . . . , ICn of FIG. 7 may be configured as illustrated in FIG. 8. FIG. 8 is a detailed circuit diagram of the initialization circuit IC1, and the other initialization circuits IC2, . . . , ICn may be configured in the same manner as the initialization circuit IC1.

The initialization circuit IC1 includes switching elements connected in series, that is, NMOS transistors M81 and M82 to apply the low-voltage ground voltage VSSD to the output terminal OUT of the level shifter LS1.

The NMOS transistor M81 is turned on when the low voltage driving voltage VCCD is applied, and the NMOS transistor M82 is turned on in response to the initialization signal.

The initialization signal may be generated to be enabled during a predetermined time from the time at which an internal voltage generation circuit (not illustrated) mounted on the PCB starts to apply a low voltage. The internal voltage generation circuit indicates a circuit to generate a high voltage and a low voltage which are required for driving a flat panel displays, using external power.

The level shifter LS1 receives a low voltage and a high voltage according to the power sequence as described with reference to FIG. 2. The level shifter LS1 is driven to receive an input signal using the low voltage, and driven to output a control signal using the high voltage.

The initialization circuit IC1 transmits the low-voltage ground voltage VSSD applied to the NMOS transistor M82 to the output terminal OUT of the level shifter LS1 when both of the NMOS transistors M81 and M82 are turned on. As a result, the control signal outputted from the level shifter LS1 is initialized to the low-voltage ground voltage VSSD.

When the initialization signal is disabled, the NMOS transistor M82 of the initialization circuit IC1 is turned off. Thus, the level shifter LS1 outputs a normal control signal regardless of the low-voltage ground voltage VSSD.

Figure 9:
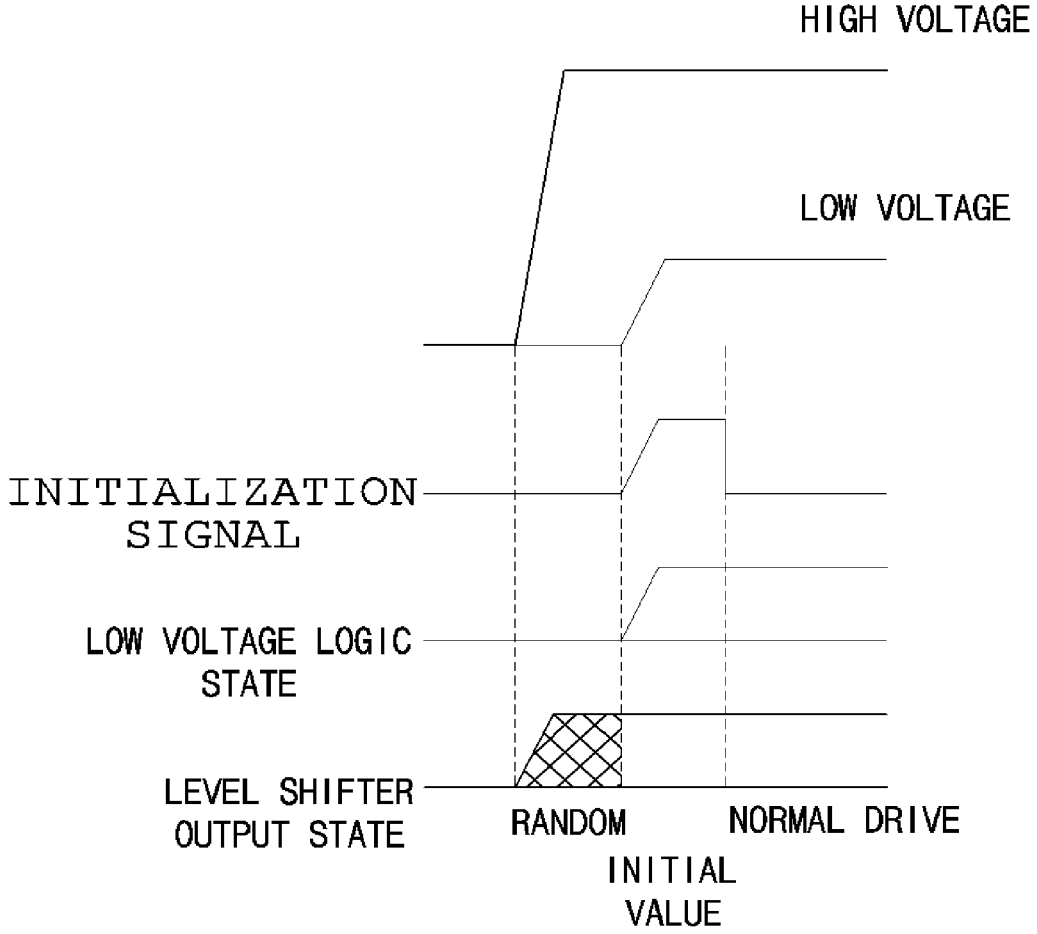
FIG. 9 is a timing diagram for explaining the operation of the embodiment of FIG. 7.

The operation of the malfunction prevention circuit according to the embodiment of the present invention will be described with reference to FIG. 9.

Based on the power sequence according to the embodiment of the present invention, a low voltage is applied in a predetermined time T after a high voltage is applied, as illustrated in FIG. 1.

During an interval between the time at which the high voltage is applied and the time at which the low voltage is applied, the respective level shifters LS1, LS2, . . . , LSn output control signals randomly because the non-inverted input signal In and the inverted input signal INb are maintained a floating state.

Thus, the transmission gates G1, G2, and G3 within the multiplexer 10, which switch outputs of the buffers BL and BH as illustrated in FIG. 4, maintain an unstable switching state according to the random control signals.

When the low voltage starts to be applied according to the power sequence, the low-voltage driving voltage VCCD and the initialization signal are applied to the initialization circuits IC1, IC2, . . . , ICn.

The NMOS transistor M81 is turned on as the low-voltage driving voltage VCCD is applied, and the NMOS transistor M82 is turned on while the initialization is enabled.

While the NMOS transistor M81 and the NMOS transistor M82 are turned on, the low-voltage ground voltage VSSD is applied to the output terminals OUT of the level shifters LS1, LS2, . . . , LSn through the turned-on NMOS transistors M81 and M82.

Thus, the control signals outputted from the level shifters LS1, LS2, . . . , LSn maintain the level of the low voltage ground voltage VSSD while the initialization signal is enabled. In this connection, the transmission gates G1, G2, and G3 of the multiplexer 10 maintain a turn-off state. That is, the initial values of the control signals outputted from the level shifters LS1, LS2, . . . , LSn may be set to a low-level constant voltage. The low-level constant voltage may be represented as the above-described low-voltage ground voltage VSSD.

While the initialization signal is enabled, the level shifters LS1, LS2, . . . , LSn maintain the control signals at the level of the low-voltage ground voltage VSSD regardless of the input signal I1, I2, . . . , In. Thus, the control signals outputted from the level shifters LS1, LS2, . . . , LSn may be set to the initial value at which the constant voltage is maintained in a random state of the previous step where only the high voltage of the power sequence was applied.

The control signals outputted from the level shifters LS1, LS2, . . . , LSn are stabilized to the initial value, and the multiplexer driver MUXD may transmit the control signals outputted from the level shifters LS1, LS2, . . . , LSn and having the stabilized initial value to the multiplexer 10. As a result, the transmission gates G1, G2, and G3 of the multiplexer 10 may be stably turned off without the occurrence of a shorted path and an over-current caused by the shorted path.

The enable time of the initialization signal may be set in various manners depending on the designer's intention.

After the high voltage and the low voltage are stabilized through the power sequence, the initialization signal may be disabled. When the initialization signal is disabled, the NMOS transistors M82 of the initialization circuits IC1, IC2, . . . , ICn are turned off.

That is, the fixation of the control signals outputted from the level shifters LS1, LS2, . . . , LSn to the low-voltage ground voltage VSSD is released.

As the power sequence is stabilized, the level shifters LS1, LS2, . . . , LSn stably receive the input signals IN and INb using the low voltage, and normally output the control signals to the output terminals OUT using the high voltage.

When the NMOS transistor M82 to apply a constant voltage in each of the initialization circuits IC1, IC2, . . . , ICn is a transistor for driving the low voltage, the NMOS transistor M81 limits a drain-source voltage of the NMOS transistor M82 to less than a level obtained by subtracting a threshold voltage from the low-voltage driving voltage VCCD, thereby having a breakdown voltage protection function of the NMOS transistor M82.

Meanwhile, when the NMOS transistor M82 is configured with a high voltage driving transistor, the initialization circuits IC1, IC2, . . . , ICn may be configured with only the NMOS transistor M82.

Whether the NMOS transistor M82 is configured with a high voltage driving transistor or low voltage driving transistor may be selected depending on whether the initialization signal is generated based on the high voltage or low voltage.

According to the embodiment of the present invention, it is possible to prevent a malfunction of the COG-form source driver integrated circuit or damage of internal parts of the COG-formed source driver integrated circuit, which may occur due to a shorted path within the COG-form source driver integrated circuit and an over-current caused by the shorted path, which are caused by an unstable output of the level shifter at the initial stage of the power sequence.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A malfunction prevention circuit for a chip-on-glass-form source driver integrated circuit with a power sequence in which a low voltage is applied after a high voltage is applied, the malfunction prevention circuit comprising:

a level shifter configured to process an input signal using the low voltage and output a control signal using the high voltage; and an initialization circuit configured to initialize the control signal outputted from the level shifter to a constant voltage while the low voltage is applied at an initial stage of the power sequence and an initialization signal is enabled, wherein the initialization signal is enabled during a predetermined time from the time at which the low voltage starts to be applied at the initial stage of the power sequence.

2. The malfunction prevention circuit of claim 1, wherein the initialization circuit applies a low-voltage ground voltage as the constant voltage.

3. The malfunction prevention circuit of claim 2, wherein the initialization circuit comprises a first switching element and a second switching element connected in series to apply the low-voltage ground voltage to an output terminal of the level shifter, and the first switching element is turned on when the low voltage starts to be applied and the second switching element is turned on while the initialization signal is enabled.

4. The malfunction prevention circuit of claim 3, wherein the first switching element is turned on by a low-voltage driving voltage, and limits a voltage applied to the second switching element from the output terminal of the level shifter.

5. The malfunction prevention circuit of claim 2, wherein the initialization circuit comprises a high voltage driving switching element configured to transmit the low-voltage ground voltage to an output terminal of the level shifter, and initializes the control signal to the low-voltage ground voltage while the initialization signal is enabled.

6. The malfunction prevention circuit of claim 1, wherein the initialization signal is provided from a circuit configured to generate the high voltage and the low voltage using external power.

7. The malfunction prevention circuit of claim 1, wherein the initialization circuit controls a short circuit caused by a turn-on of a transmission gate which is operated in response to the control signal within a multiplexer, through the initialization of the control signal.

8. A malfunction prevention circuit of a chip-on-glass-form source driver integrated circuit with a power sequence in which a low voltage is applied after a high voltage is applied, the malfunction prevention circuit comprising:

a plurality of level shifters each configured to process an input signal using the low voltage and output a control signal using the high voltage;

a multiplexer driver configured to transmit the control signals of the plurality of level shifters to corresponding multiplexers; and a plurality of initialization circuits each configured to initialize the control signal outputted from the plurality of level shifters to a constant voltage while the low voltage is applied at an initial stage of the power sequence and an initialization signal is enabled, wherein the initialization signal is enabled during a predetermined time from the time at which the low voltage starts to be applied at the initial stage of the power sequence.

9. The malfunction prevention circuit of claim 8, wherein the plurality of initialization circuits each applies a low-voltage ground voltage as the constant voltage.

10. The malfunction prevention circuit of claim 9, wherein the plurality of initialization circuits each comprises a first switching element and a second switching element connected in series to apply the low-voltage ground voltage to each output terminal of each corresponding level shifter, and the first switching element is turned on when the low voltage is applied and the second switching element is turned on while the initialization signal is enabled.

11. The malfunction prevention circuit of claim 10, wherein the first switching element is turned on by a low-voltage driving voltage, and limits a voltage applied to the second switching element from the output terminal of the level shifter.

12. The malfunction prevention circuit of claim 8, wherein the initialization signal is provided from a circuit configured to generate the high voltage and the low voltage using external power.

13. The malfunction prevention circuit of claim 8, wherein the plurality of initialization circuits control a short circuit caused by a turn-on of a transmission gate which is operated in response to the control signal within a multiplexer, through the initialization of the control signal.

14. A flat panel display controller comprising:

a printed circuit board having a power sequence in which a low voltage is applied after a high voltage is applied; and a chip-on-glass-form source driver integrated circuit configured to receive the high voltage and the low voltage, wherein the chip-on-glass-form source driver integrated circuit comprises:

multiplexers configured to select and output one of an even signal and an odd signal;

a plurality of level shifters each configured to process an input signal using the low voltage and output a control signal using the high voltage;

a multiplexer driver configured to transmit the control signals of the plurality of level shifters to corresponding multiplexers; and a plurality of initialization circuits each configured to initialize the control signal outputted from the plurality of level shifters to a constant voltage while the low voltage is applied at an initial stage of the power sequence and an initialization signal is enabled, wherein, the initialization signal is enabled during a predetermined time from the time at which the low voltage starts to be applied at the initial stage of the power sequence.

15. The flat panel display controller of claim 14, wherein the plurality of initialization circuits each applies a low-voltage ground voltage as the constant voltage.

16. The flat panel display controller of claim 15, wherein the plurality of initialization circuits each comprises a first switching element and a second switching element connected in series to apply the low-voltage ground voltage to each output terminal of each corresponding level shifter, and the first switching element is turned on when the low voltage is applied and the second switching element is turned on while the initialization signal is enabled.

17. The flat panel display controller of claim 16, wherein the first switching element is turned on by a low-voltage driving voltage, and limits a voltage applied to the second switching element from the output terminal of the level shifter.

18. The flat panel display controller of claim 14, wherein the initialization signal is provided from a circuit which is mounted on the printed circuit board and configured to generate the high voltage and the low voltage using external power.

19. The flat panel display controller of claim 14, wherein the initialization circuit controls a short circuit of buffers outputting the even signals and the odd signals of the multiplexers through the initialization of the control signal.

* * * * *